United States Patent [19]

Schwarz

[11] Patent Number: 4,581,849

[45] Date of Patent: Apr. 15, 1986

[54] REVOLVING DOOR CONTROL

[76] Inventor: Milan Schwarz, c/o Revolving Door Control, Inc., 2011-B E. Gladstone St., Glendora, Calif. 91740

[21] Appl. No.: 660,476

[22] Filed: Oct. 12, 1984

[51] Int. Cl.[4] ..... E05F 15/10; E05D 15/02

[52] U.S. Cl. ..... 49/32; 49/29; 49/42

[58] Field of Search ..... 49/42, 32, 29, 43, 44

[56] References Cited

U.S. PATENT DOCUMENTS

| | | | |
|---|---|---|---|
| 1,278,145 | 9/1918 | Haviland | 49/42 X |
| 2,341,545 | 2/1944 | Hagenbook | 49/42 |
| 4,154,023 | 5/1979 | Carroll | 49/32 |
| 4,475,308 | 10/1984 | Heise et al. . | |

*Primary Examiner*—Philip C. Kannan

*Attorney, Agent, or Firm*—Christie, Parker & Hale

[57] ABSTRACT

A motor drive and control system is set forth for use with revolving doors. To operate the door and revolve the revolving door panels a motor is coupled to the revolving door shaft. The motor is of the d-c type having a fixed, permanent magnet and a rotating armature. A relay is provided which is energized when a person enters the door and begins to push on a selected panel. Pushing on the panel partially rotates the shaft as well as the motor armature. Rotation of the armature generates the voltage to trigger a relay which, in turn, energizes the motor to rotate the shaft and revolve the panels approximately 180 degrees between the entrance and exit as determined by a timer to pass an individual through the door.

9 Claims, 4 Drawing Figures

REVOLVING DOOR CONTROL

FIELD OF THE INVENTION

This invention relates to revolving doors and more particularly motorized revolving doors and controls therefor.

BACKGROUND OF THE INVENTION

Revolving doors provide a means for entering or leaving a building or room in an orderly fashion and in such a manner as to converse heating or cooling energy within the building or room. Further, revolving doors are capable of permitting persons to pass therethrough without using their hands. Specifically, revolving doors include a cylindrical housing disposed or incorporated into the wall of the building or room. Within the housing is a rotatable shaft mounting a plurality of panels which extend outwardly from the shaft to closely adjoin the housing. Between any pair of adjacent panels a cylindrical sector-shaped compartment is defined which revolves upon rotation of the shaft between an entrance and an exit provided in the housing to move a person through the revolving door.

To pass through the revolving door, a person enters the door at either the entrance or exit and steps into a a compartment. Pushing against a panel, the person causes the shaft to rotate and the panels to revolve so that the compartment travels around the housing to ultimately pass the person through the door. As can be appreciated, for large revolving doors, a relatively strong push is required to overcome the inertia of the door to revolve the panels and pass the individual through the door. Further, the panels typically have seals which bear against the housing to prevent air from escaping through the door. When these seals are new a large force is required to overcome the frictional engagement with the housing which, when combined with the force necessary to overcome inertia, makes it difficult for most persons, and especially the elderly, handicapped or those with their hands full of goods to pass through the door.

To overcome this problem, it has been known to provide motors to revolve the panels and the compartments between the entrance and exit. For example, in U.S. Pat. No. 4,341,165 issued to Calandritti et al on July 27, 1982, a motor is provided which is actuated by a switch located at one of the panels. To pass through the door, the person depresses the switch which activates the motor to revolve the panels. In Carroll et al U.S. Pat. No. 4,295,297, issued Oct. 20, 1981 a sensor either of the infrared or microwave type is positioned to sense the approach of a person and to activate a motor to revolve the panels. These systems, however, are expensive and complicated, detracting from the reliability of the door.

SUMMARY OF THE INVENTION

There is, therefore, provided in the practice of the present invention a motor drive and control system therefor which is simple, relatively inexpensive and is reliable.

The motor drive and control system cooperates with any selected revolving door. The revolving door includes a cylindrical housing having an entrance and opposed exit. Within the housing there is shaft which mounts a plurality of panels extending outwardly from the shaft to revolve closely adjacent the housing. Between each pair of adjacent panels a compartment is defined which, when the door is activated, revolve between the entrance and exit to pass an individual who walks therealong through the door.

To operate the door and revolve the panels and compartments, a motor is coupled to the shaft. The motor is of the d-c type having a fixed, permanent magnet and a rotating armature. When the motor is energized, the armature is driven to rotate the shaft and revolve the panels and the compartments between the entrance and exit. When energized and the panels revolve, the individual walks with the compartment as he progresses between the entrance and exit.

To control the motor, switch means are provided which are energized when a person enters the door and begins to push on a selected panel. Pushing on the panel partially rotates the shaft as well as the motor armature. Rotation of the armature generates the voltage to trigger the switch means. When the switch means are triggered the motor is, in turn, energized to rotate the shaft and revolve the panels and compartments approximately 180 degrees between the entrance and exit to pass an individual through the door.

More particularly, the switch means are embodied as a relay. When the armature begins to rotate, a voltage is generated to close the relay which, in turn, supplies power to the motor and energizes a timer. The timer deenergizes the relay and motor at the expiration of the time necessary to revolve the compartment between the entrance and exit and to stop the door in readiness to receive another person.

As can be appreciated, the revolving door and control system according to the present invention does not require expensive switches or sensors at various and numerous locations within the door. Rather, the door control system conveniently utilizes the voltage generated by the d-c motor when the armature begins to rotate as a person pushes against the revolving door panel.

BRIEF DESCRIPTION OF THE DRAWINGS

These and other features and advantages will become apparent as the same becomes better understood with reference to the specification, claims and drawings wherein:

FIG. 2 is a top schematic view of the revolving door, FIG. 1, showing a revolution thereof to pass individuals there through;

DETAILED DESCRIPTION

Figure 1:
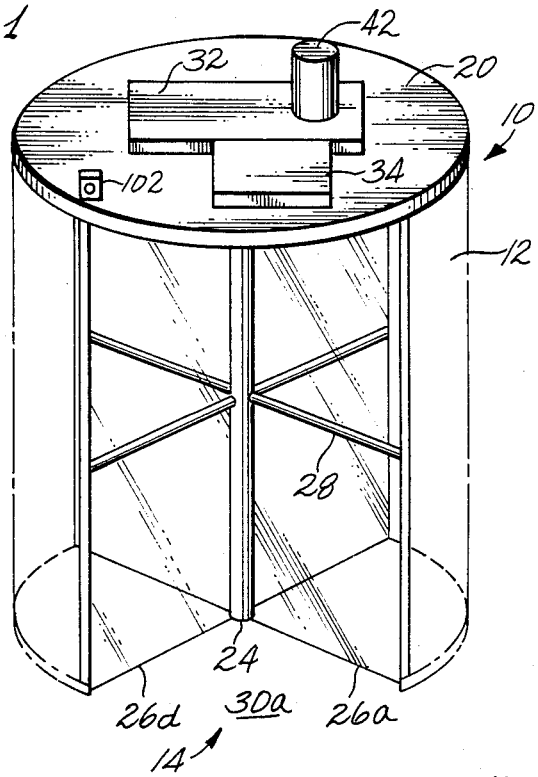
FIG. 1 is a perspective view of a revolving door according to the present invention.
Figure 2:
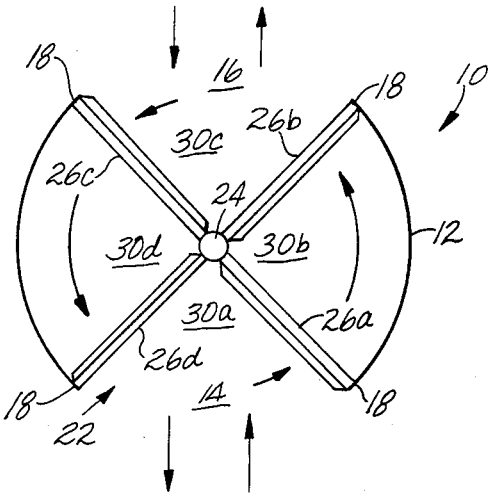

Turning to FIGS. 1 and 2, a revolving door 10 according to the present invention is shown. The door 10 includes a cylindrical housing 12 which is closed except for an entrance 14 and an oppositely disposed exit 16. At its lowermost extend the housing 12 includes a bottom which may be a concrete slab or the like. Opposite the bottom, the housing 12 includes a top 20 which is for the most part closed. The envelope created within the housing 12 defines a cylindrical chamber 22.

Disposed in the chamber, the door 10 includes a shaft 24 journaled at both the top 20 and bottom. Affixed to the shaft 24 and extending outwardly therefrom are a plurality of door panels 26*a–d* which are commonly fashioned from a frame and a glass. Each panel is rectangular extending between the top 20 and bottom and from the shaft 24 to a position adjacent the housing 12. A handrail 28 extends across each panel 26*a–d* at a location suitable to be pushed against by a person entering the door 10.

As seen in FIGS. 1 and 2, each pair of adjacent panels divides the chamber 22 into cylindrical sectors each defining a compartment 30*a–d*. When a person passes through the door 10, the shaft 24 rotates to revolve the panels 26*a–d* moving each compartment in sequence around the housing 12 between the entrance 14 and exit 16. To pass through the door 10, a person steps into a selected compartment and moves therewith between the entrance and exit.

While the drawings and the foregoing description show a particular type of revolving door having four panels and, therefore, four compartments it is to be understood that the revolving door control according to the present invention is equally useful with doors having more or fewer panels and compartments.

Most revolving doors according to the prior art are freely rotating, that is, no means are provided to drive the rotation of the shaft and the revolving of the panels. When a person's hands are full, or because of physical handicap, it may be difficult to urge the panels to revolve due to the inertia of the door and/or the frictional engagement of seals 18 (FIG. 2) which extend the length of each panel. The seals 18 are adapted to seal each panel against the housing 12 to prevent the escape of air through the door. When the seals 18, typically fashioned from a rubber-like material, are new the frictional engagement against the housing when coupled with the inertia of the panels and shaft make the door particulars difficult to revolve. Accordingly, the drive and motor control according to the present invention are provided.

Figure 3:
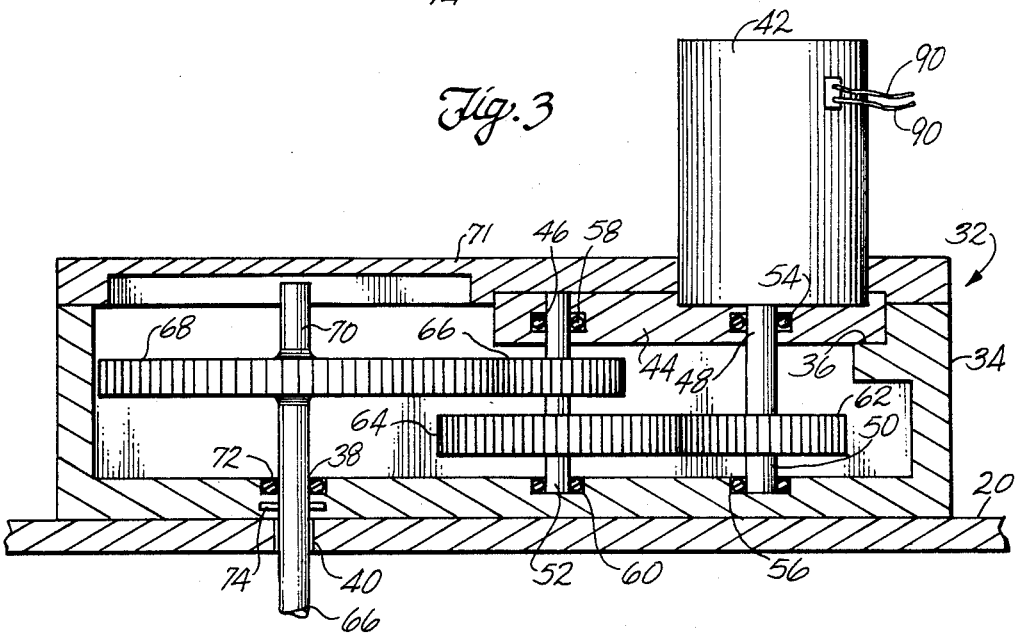
FIG. 3 is a partial section view of the revolving door drive means.

Turning to FIG. 3, the drive of the shaft 24 to revolve the panels 26 to move a person through the door 10 is shown. The drive for the shaft 24 is housed within a casing 32 which is affixed to the top 20. The casing 32 has a lower portion 34 which is upwardly open and includes a ledge 36 near one end thereof. At another portion of the lower portion 34 is a bore 38. The casing 32 is arranged such that the bore 38 registers with a hole 40 in the top 20 for coupling the drive to the shaft 24.

To drive the door and more particularly its shaft 24 for revolving the panels 26, the door includes a 90 VDC motor 42. The motor 42 is of the type having a fixed, permanent magnet and a rotatable armature (not shown). When the motor and more particularly its armature is energized with a d-c voltage, the armature is caused to rotate and provide the mechanical power to drive the shaft 24. It has been found that a motor having the following specifications is suitable for rotating the shaft 24 and revolving the panels 26:

90 VDC
1.2 amperes
⅛ HP
1800 RPM

The motor 42 is secured to a mount 44 which is, in turn, positioned on or is secured to the ledge 36. A pair of spaced bores 46 and 48 extend through the mount 44 to pass a motor drive shaft 50 and to journal a first stub shaft 52. The drive shaft 50 is journaled in bore 48 by bearings 54 and is journaled to the lower portion 34 by bearings 56. The first stub shaft 52 is journaled in bore 46 by bearings 58 and to the lower portion 34 by bearings 60.

Disposed on the drive shaft 50 is a pinion gear 62 which meshes with a first gear 64 keyed to the first stub shaft 52. When the motor 42 is energized, the drive shaft 50 rotates to rotate the pinion gear 62, first gear 64 and the first stub shaft 52. Also, keyed to the first stub shaft 52 is a smaller, second gear 66. The second gear 66 meshes with a larger drive gear 68 which is keyed to a second stub shaft 70. The second stub shaft 70 passes through the bore 38 and the hole 40 and is journaled therein by a bearing 72, the bore 38 being sealed with an appropriate seal 74 to prevent lubricant from passing therethrough. Accordingly, when the motor 42 is energized, the drive gear 68 is caused to rotate via the second gear 66, first gear 64, and pinion gear 62. Preferably, the aforementioned gears are selected to provide a 100 to 1 gear ratio between the drive shaft 50 and the second stub shaft 70. The second stub shaft 70 extends through the top 20 and includes means for coupling the second stub shaft 70 to the shaft 24, such as splines 66, pins or the like. Upon energizing of the motor 42, therefore, the shaft 24 is caused to rotate and the panels 26 to revolve. A cover 71 is affixed to the lower portion to protect the various gears and shafts. The cover 71 may also be adapted to trap and hold the mount 44 to the ledge 36.

Figure 4:
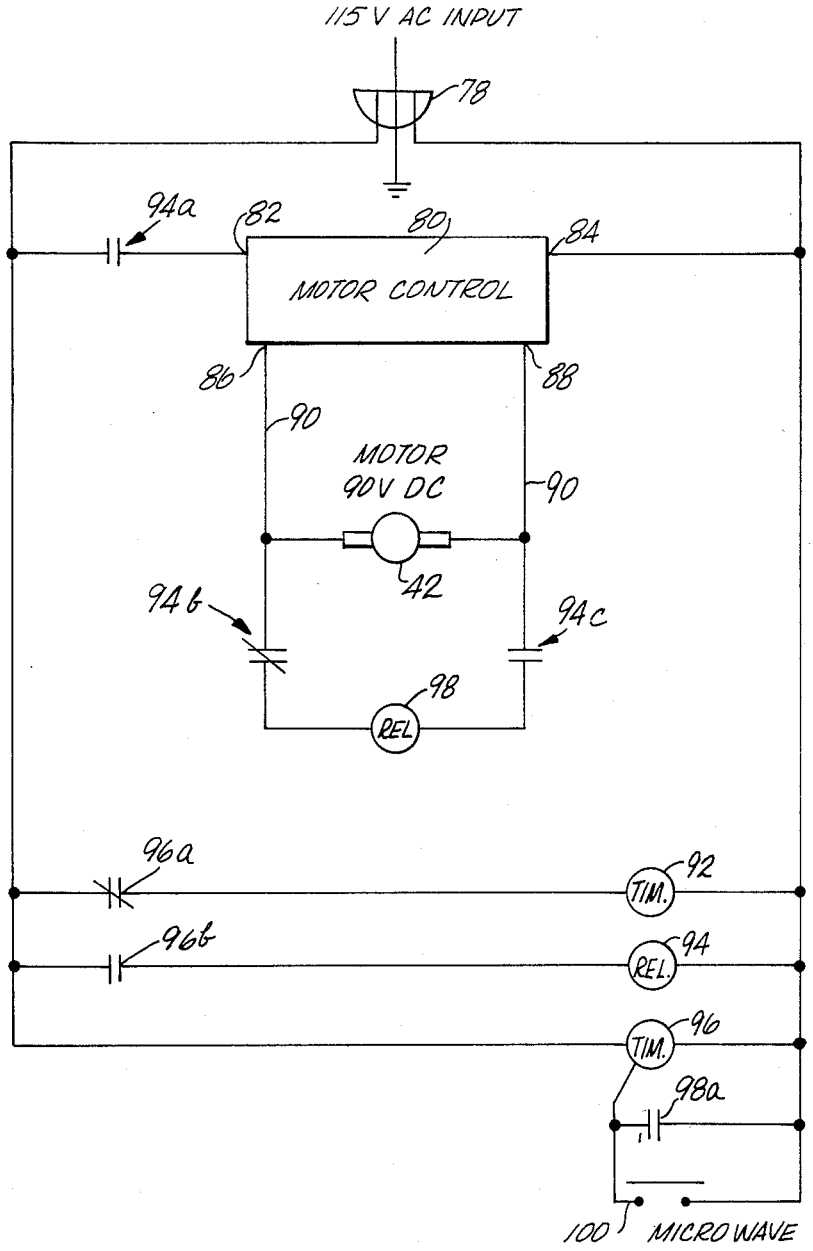
FIG. 4 is an electrical schematic showing the controls for the revolving door.

To control the motor 42 and thereby the drive of the shaft 24 to revolve the panels 26, the control as shown in FIG. 4 is provided. The control is powered from a 115 volt a-c input power source 78. Via the circuit of FIG. 4, power from the source 78 is controllably supplied to the motor 42 to control its operation.

To provide for the conversion of the 115 VAC input source 78 to d-c power acceptable by the motor 42, and to provide motor speed and torque control, a motor control 80 is incorporated into the circuit. The motor control 80 has 115 VAC power input connections 82 and 84 to receive the 115 VAC power from source 78. The motor control 80 also has 90 VDC output connections 86 and 88 connected to the motor 42 by wires 90 or the like. When power is supplied to the motor control 80, at the connections 82 and 84, the a-c power is converted into 90 VDC and is supplied from the connections 86 and 88 to the motor 42. By suitable adjustments on the motor control 80, the power supplied to the motor may be adjusted to alter the motor's speed and torque output.

A motor control 80 useful for this purpose is available from Minarik Electric Co., 232 East 4th St., Los Angeles, Calif.

The motor control circuitry is enclosed within a protective container disposed on the revolving door top 20 adjacent the casing 32.

Included in the motor control circuit is a 115 VAC on-delay timer 92 energized when the circuit is first connected to the source 78. Associated with and cooperating with the on-delay timer 92, is a 115 VAC first relay 94 having three contact pairs 94*a*, 94*b* and 94*c* in the circuit as shown and operating in a fashion discussed below.

The circuit also includes a 115 VAC off-delay timer 96, having associated therewith in the circuit contact pairs 96*a* and 96*b*. To energize the off-delay timer 96, the circuit includes a 6 VDC coil second relay 98 connected across the motor terminals. Contact pairs 94*b* and 94*c* act between the second relay 98 and the motor terminals. The second relay 98 has a contact pair 98*a* connected between the source 78 and the off-delay timer 96.

Initially, contact pairs 94*b* and 96*a* are closed as shown in FIG. 4, so that when power is supplied at the source 78 the circuit is completed across on-delay timer 92 and between connection 86 and the second relay 98. This energizes the on-delay timer 92 which times out (preferably in about 1 to 2 seconds) and at the expiration of such time closes the contact pair 94*c* to complete the circuit to the second relay 98.

When a person pushes on a panel 26 as he first enters the door 10, the shaft 24 and armature of the motor 42 rotates creating a voltage across the second relay 98. At or about six volts the relay 98 is triggered which closes contact pair 98*a* completing the circuit to the off-delay timer 96. Simultaneously, contact pair 96*a* opens to reset the on-delay timer 92 and contact pair 96*b*closes to energize the first relay 94. When the first relay 94 is energized, contact pair 94*b* opens to deenergize the second relay 98 to protect it from the 90 VDC supplied to the motor 42 and relay pair 94*a* closes providing power to the motor control 80 and to the motor 42. When the second relay 98 is deenergized, contact pairs 98*a* opens which initiates the timing cycle of the off-delay timer 96. When the motor 42 is energized, the shaft 24 is rotated to revolve the panels at a speed and torque as set by adjustments to the motor control 80 for the time determined by the off-delay timer 96. The offdelay timer as well as the on-delay timer are adjustable, the off-delay timer being set to energize the motor 42 for a time necessary to revolve the panels approximately 180 degrees to pass a person through the door 10.

At expiration of the time set by the off-delay timer 96 the contact pair 96*b* opens deenergizing the first relay 94 and contact pair 96*a* closes to energize the on-delay timer 92. Contact pair 96*a* closes and contact pairs 94*a* and 96*b* are opened, deenergizing the motor 42, the circuit assuming the state shown in FIG. 4.

As can be appreciated from the foregoing, the motor control advantageously utilizes the voltage generated when the motor armature is rotated to trigger the driving of the shaft and revolving of the panels. Therefore, external switches and the like are not necessary. Torque can be adjusted through the motor control 80 so that the door can be held against the power of the motor should, for whatever reason, a person become trapped in the door.

As shown in FIG. 4, a microwave, infrared or similar type of switch 100 may be provided in the circuit, the switch 100 closing when a sensor 102 (FIG. 1) senses an individual entering the door 100 to energize the off-delay timer 96 and thereby the motor 42. The sensor 102 is typically a microwave transceiver adapted to send microwave signals to sense the presence of the person.

While I have shown and described certain embodiments of the present invention, it is to be understood that it is subject to modification without departing from the spirit of scope of the invention as set forth in the following claims.

What is claimed is:

1. In a revolving door having a housing with an entrance and exit, a shaft rotatably disposed in a housing, a plurality of panels affixed to the shaft and extending outwardly therefrom to the housing to define a plurality of compartments movable in a revolving fashion between the entrance and exit to pass a person through the door, the improvement comprising:

a d-c motor coupled to the shaft, the motor when energized rotating the shaft to move a compartment between the entrance and exit, the motor including a permanent magnet and an armature coupled to the shaft; and means for controlling the motor including, first switch means energized by rotation of the armature as a person pushes against one of the panels to begin to rotate the shaft, the first switch means energizing the motor to rotate the shaft, and means for deenergizing the motor when the compartment has moved between the entrance and exit.

2. The door of claim 1 wherein the first switch means is a relay triggered by the voltage generated when the armature is rotated.

3. The door of claim 2 wherein the deenergizing means is a timer activated when the motor is energized, the timer deenergizing the motor at the expiration of a time necessary to pass a person through the door.

4. A revolving door comprising:

a housing having an entrance and an exit;

a shaft rotatably disposed in the housing;

a plurality of panels secured to the shaft and extending outwardly therefrom to the housing, rotation of the shaft revolving the panels within the housing to pass a person through the door between the entrance and exit;

a d-c motor coupled to the shaft, the motor including an armature rotatable with the shaft;

first switch means energized by rotation of the armature when a person enters the door, pushes against a panel and rotates the shaft, the first switch means energizing the motor to rotate the shaft; and means for deenergizing the motor when the shaft has rotated an amount sufficient to pass a person through the door.

5. The door of claim 4 wherein the first switch means is a relay triggered by the voltage generated as the armature rotates.

6. The door of claim 5 wherein the deenergizing means is a timer activated when the motor is energized, at the expiration of a preselected time required to pass a person through the door the timer de-energizing the motor.

7. The door of claim 4 further includes means for sensing a person at one of the entrance or exit and second switch means triggered by the sensing means to energize the motor and rotate the shaft.

8. The door of claim 7 wherein the sensing means is a microwave transceiver.

9. In a revolving door having a housing with an entrance and exit, a shaft rotatably disposed in a housing, a plurality of panels affixed to the shaft and extending outwardly therefrom to the housing to define a plurality of compartments movable in a revolving fashion between the entrance and exit to pass a person through the door, the improvement comprising:

a d-c motor coupled to the shaft, the motor when energized rotating the shaft to move a compartment between the entrance and exit, the motor including a permanent magnet and an armature coupled to the shaft;

means for controlling the motor including a control circuit having, a first timer energized from a power source, upon the expiration of a selected time the first timer closes contacts to complete a circuit around the armature;

a relay disposed in the circuit around the armature, the relay triggered by the voltage generated when a person pushes on a panel to rotate the shaft and armature, the relay triggering a second timer and another relay breaking the circuit around the armature and energizing the motor to rotate the shaft, at the expiration of a period of time, the second timer deenergizing the motor and energizing the first timer.

* * * * *